US012337253B1

(12) United States Patent
Cruse

(10) Patent No.: US 12,337,253 B1
(45) Date of Patent: Jun. 24, 2025

(54) DECORATIVE ILLUMINATED SANDMAN FIGURINE

(71) Applicant: Kristina Cruse, Spring Hill, FL (US)

(72) Inventor: Kristina Cruse, Spring Hill, FL (US)

( * ) Notice: Subject to any disclaimer, the term of this patent is extended or adjusted under 35 U.S.C. 154(b) by 194 days.

(21) Appl. No.: 18/109,316

(22) Filed: Feb. 14, 2023

(51) Int. Cl.
*A63H 3/16* (2006.01)
*A63H 3/00* (2006.01)

(52) U.S. Cl.
CPC ..... *A63H 3/006* (2013.01)

(58) Field of Classification Search
CPC ..... A63H 3/006
See application file for complete search history.

(56) References Cited

U.S. PATENT DOCUMENTS 1,577,903 A * 3/1926 Gover ..... A63H 13/005 446/353
2,633,668 A * 4/1953 Schaefer ..... A63H 3/006 362/276
2,748,256 A * 5/1956 Moran ..... F21S 4/10 40/538
2,932,917 A * 4/1960 Patane ..... A63H 3/006 362/186
3,531,634 A * 9/1970 Plouch ..... A63H 13/00 116/28 R
3,672,083 A * 6/1972 Moran ..... A63H 3/06 40/540
3,710,507 A * 1/1973 Poynter ..... A63H 13/04 366/208
3,841,019 A * 10/1974 Lorenzo ..... A63H 3/365 428/7
4,299,386 A * 11/1981 Kulesza ..... A63H 13/06 273/455
4,464,861 A * 8/1984 Fogarty ..... A63H 3/006 446/175
4,521,205 A * 6/1985 Spector ..... A63H 3/006 360/79
4,547,171 A * 10/1985 Horimoto ..... A63H 3/006 446/72

(Continued)

FOREIGN PATENT DOCUMENTS

EP 1659555 5/2006

OTHER PUBLICATIONS

Completely Coastal, The Cutest Beach Snowman, Nov. 26, 2022, www.completely-coastal.com, 10 pages.*

*Primary Examiner* — Eugene L Kim
*Assistant Examiner* — Matthew B Stanczak

(57) ABSTRACT

The decorative illuminated sandman figurine is a decorative structure. The decorative illuminated sandman figurine forms a figurine. The decorative illuminated sandman figurine presents an image of one or more indicia. The indicia presented by the decorative illuminated sandman figurine stimulates a sentiment within a viewer. The sentiment stimulated by the decorative illuminated sandman figurine includes sentiments associated with winter. The sentiment stimulated by the decorative illuminated sandman figurine further includes sentiments associated with a beach. The decorative illuminated sandman figurine includes a puppet structure, a pedestal structure, and a lamp circuit. The lamp circuit illuminates the puppet structure. The pedestal structure forms load bearing structure that transfers the load of the puppet structure to a supporting surface.

3 Claims, 5 Drawing Sheets

(56) References Cited

U.S. PATENT DOCUMENTS 5,336,536 A * 8/1994 Oberzan ..... F21S 4/10 428/9
5,380,237 A * 1/1995 Kenyon ..... A63H 3/16 446/268
5,814,380 A * 9/1998 Tamborello ..... B44C 5/00 428/58
D414,686 S 10/1999 Simpson
6,180,193 B1 * 1/2001 Bostedt ..... A63H 3/006 428/3
6,284,330 B1 * 9/2001 Hermanson ..... B44C 5/00 428/7
6,345,457 B1 2/2002 Bradley
D523,271 S * 6/2006 Nida ..... D6/523
D542,702 S 5/2007 Harper
7,322,137 B2 1/2008 Machala
D589,572 S * 3/2009 Ferguson ..... D21/629
7,625,095 B1 * 12/2009 Ohs ..... G09F 13/04 362/812
7,757,435 B1 * 7/2010 Boskofsky ..... A47G 33/0881 47/40.5
10,661,191 B1 * 5/2020 Reeves ..... A63H 11/10
10,953,337 B1 * 3/2021 Robarge ..... G09F 19/08
11,170,674 B1 * 11/2021 Wu ..... G09F 13/34
D1,002,757 S * 10/2023 Wang ..... D21/629
D1,011,226 S * 1/2024 Tang ..... D11/125
D1,024,837 S * 4/2024 Wang ..... D11/128
D1,030,548 S * 6/2024 Wu ..... D21/629
D1,035,797 S * 7/2024 Webber ..... D21/627
12,070,699 B1 * 8/2024 Gu ..... G09F 19/08
2002/0089854 A1 * 7/2002 Liu ..... F21V 3/00 362/311.06
2002/0111109 A1 * 8/2002 Kwan ..... A63H 3/06 446/220
2006/0025037 A1 * 2/2006 Lau ..... G09F 15/0025 446/226
2006/0114671 A1 * 6/2006 Cranor ..... A63H 3/36 362/228
2006/0164856 A1 * 7/2006 Wang ..... F21V 3/023 362/806
2007/0032166 A1 * 2/2007 Wei ..... A63H 9/00 446/331
2007/0097685 A1 5/2007 Gan
2008/0278948 A1 * 11/2008 Li ..... G09F 19/08 362/249.16
2009/0122538 A1 5/2009 Pan
2009/0170398 A1 * 7/2009 Chang ..... A63H 3/006 446/219
2013/0063932 A1 * 3/2013 Nussbaum ..... F21S 6/002 362/249.05
2013/0119231 A1 * 5/2013 Asperas ..... A63H 33/001 249/175
2014/0211499 A1 * 7/2014 Fong ..... H05B 45/00 362/558
2015/0184844 A1 * 7/2015 Zhang ..... F21V 33/0028 362/96
2016/0312995 A1 * 10/2016 Zhang ..... F21V 31/04
2017/0175993 A1 * 6/2017 Fornataro ..... A47G 33/08
2017/0252659 A1 * 9/2017 Kreps ..... A63H 3/38
2018/0304167 A1 * 10/2018 Jones ..... F25C 3/00
2019/0103736 A1 * 4/2019 Tsai ..... H01M 50/204
2019/0318673 A1 * 10/2019 Newton ..... G09F 19/08
2019/0381413 A1 * 12/2019 Asperas ..... A63H 9/00
2022/0199584 A1 * 6/2022 Ji ..... G06N 10/00
2022/0339962 A1 * 10/2022 Winters ..... A63H 3/006
2023/0191272 A1 * 6/2023 Wang ..... G09F 19/08 446/226
2023/0381678 A1 * 11/2023 Gu ..... A63H 3/36
2024/0009586 A1 * 1/2024 Anderson ..... A63H 33/001

* cited by examiner

DECORATIVE ILLUMINATED SANDMAN FIGURINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of the application of lighting devices or systems for decorative purposes, not provided for in codes F21W2102/00-F21W2107/00. (F21W2121/00)

SUMMARY OF INVENTION

The decorative illuminated sandman figurine is a decorative structure. The decorative illuminated sandman figurine forms a figurine. The decorative illuminated sandman figurine presents an image of one or more indicia. The indicia presented by the decorative illuminated sandman figurine stimulates a sentiment within a viewer. The sentiment stimulated by the decorative illuminated sandman figurine includes sentiments associated with winter. The sentiment stimulated by the decorative illuminated sandman figurine further includes sentiments associated with a beach. The decorative illuminated sandman figurine comprises a puppet structure, a pedestal structure, and a lamp circuit. The lamp circuit illuminates the puppet structure. The pedestal structure forms load bearing structure that transfers the load of the puppet structure to a supporting surface.

These together with additional objects, features and advantages of the decorative illuminated sandman figurine will be readily apparent to those of ordinary skill in the art upon reading the following detailed description of the presently preferred, but nonetheless illustrative, embodiments when taken in conjunction with the accompanying drawings.

In this respect, before explaining the current embodiments of the decorative illuminated sandman figurine in detail, it is to be understood that the decorative illuminated sandman figurine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the decorative illuminated sandman figurine.

It is therefore important that the claims be regarded as including such equivalent construction insofar as they do not depart from the spirit and scope of the decorative illuminated sandman figurine. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
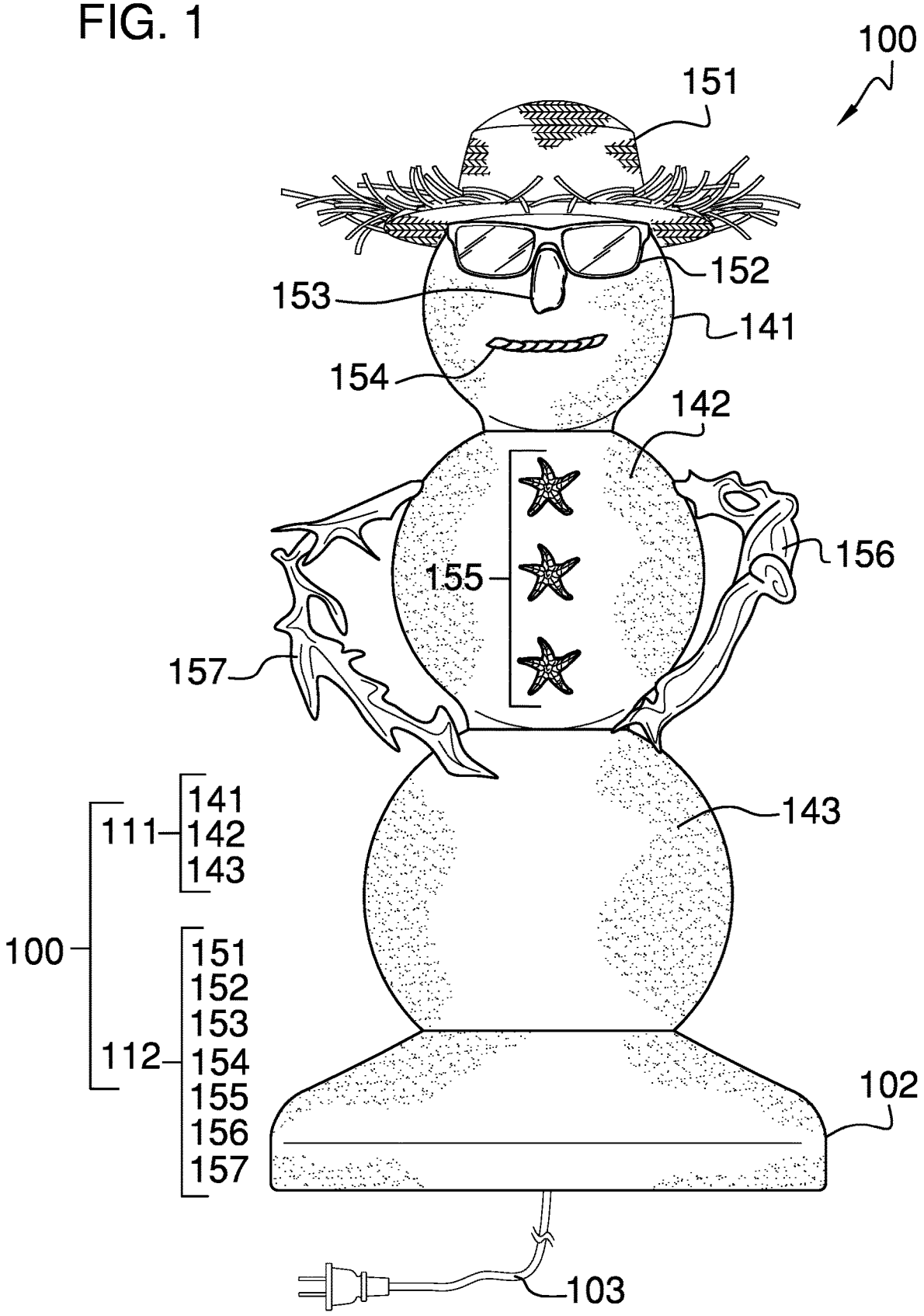
FIG. 1 is a front view of an embodiment of the disclosure.
Figure 2:
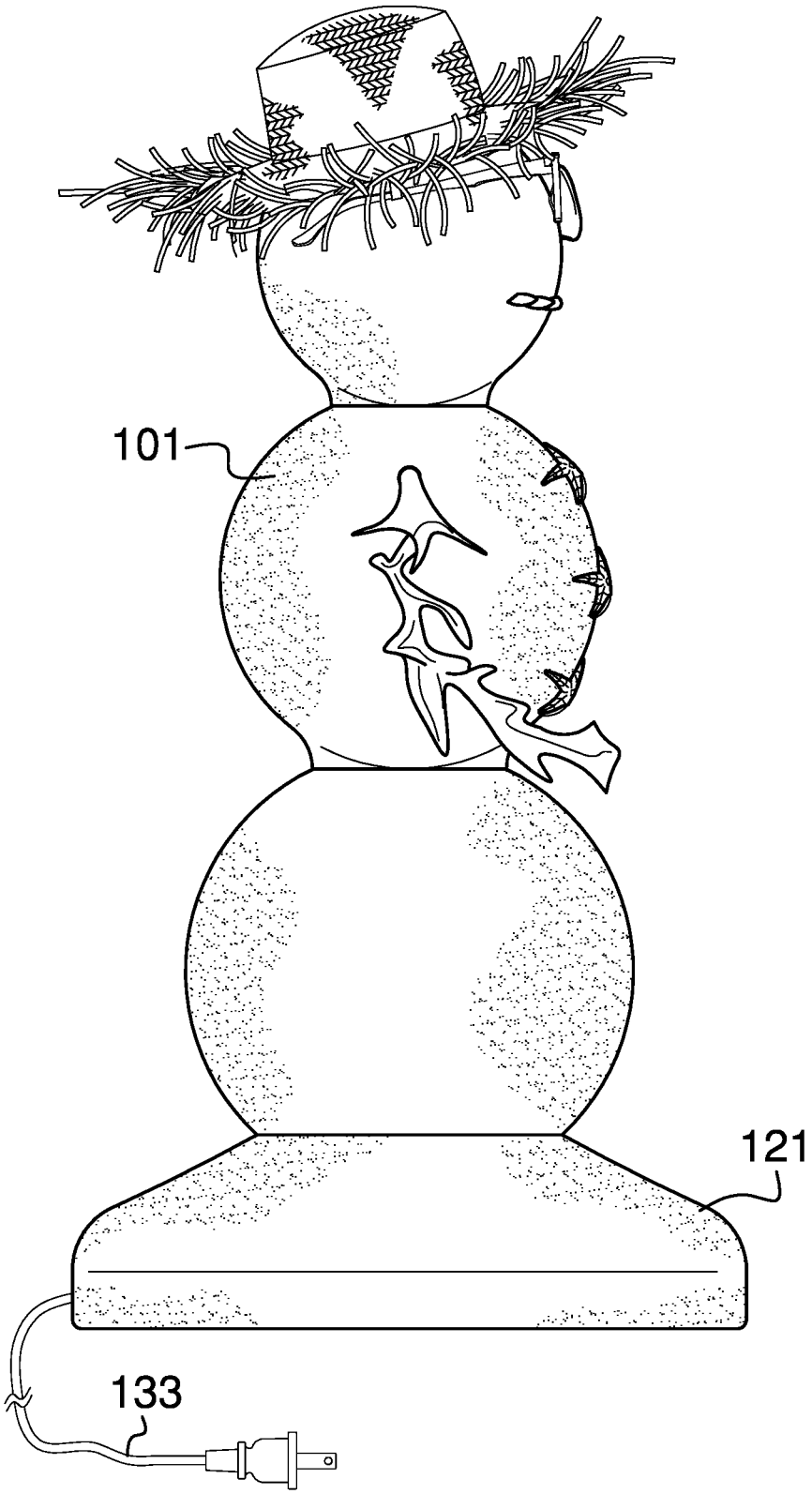
FIG. 2 is a side view of an embodiment of the disclosure.
Figure 3:
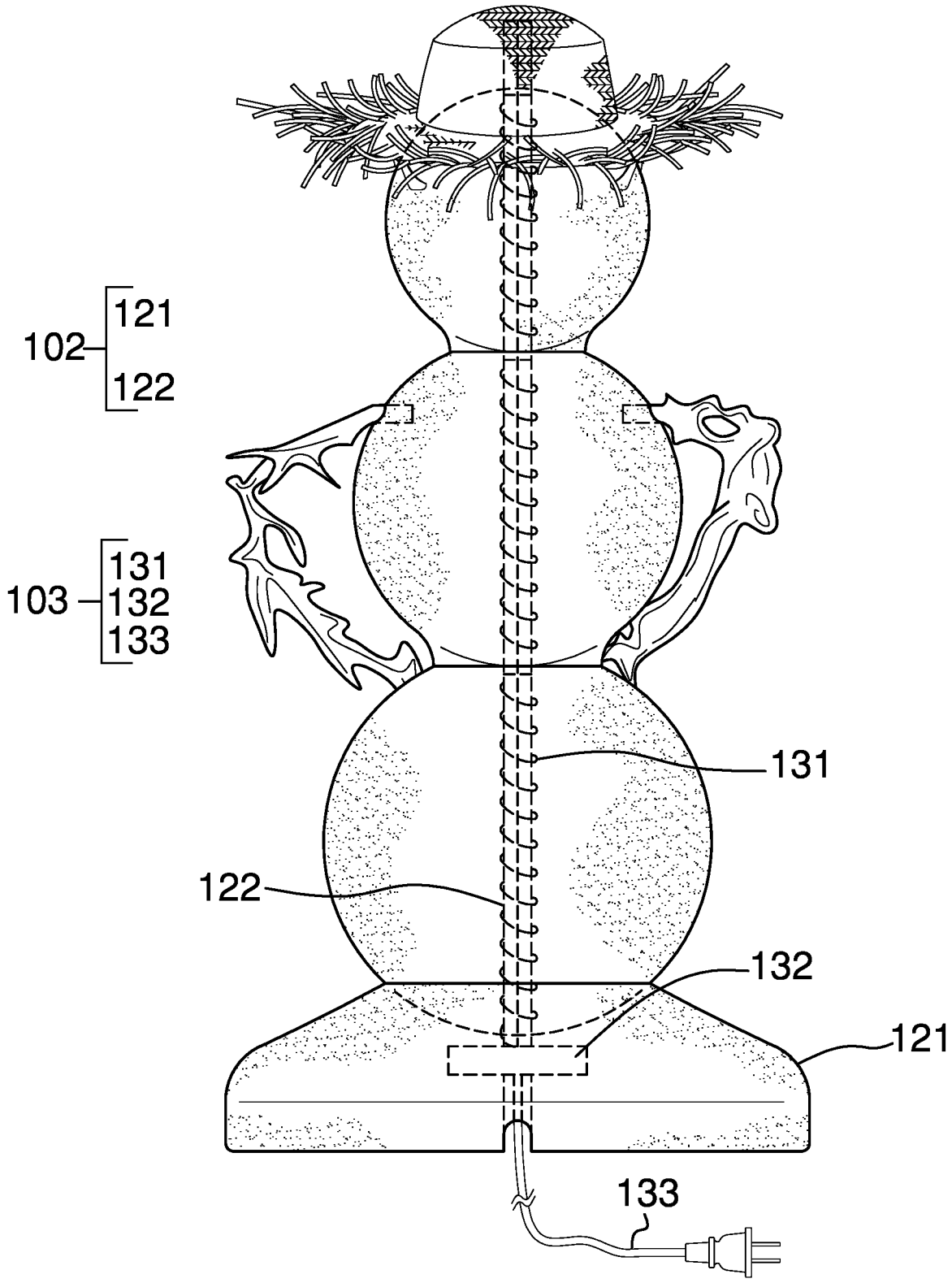
FIG. 3 is a top view of an embodiment of the disclosure.
Figure 4:
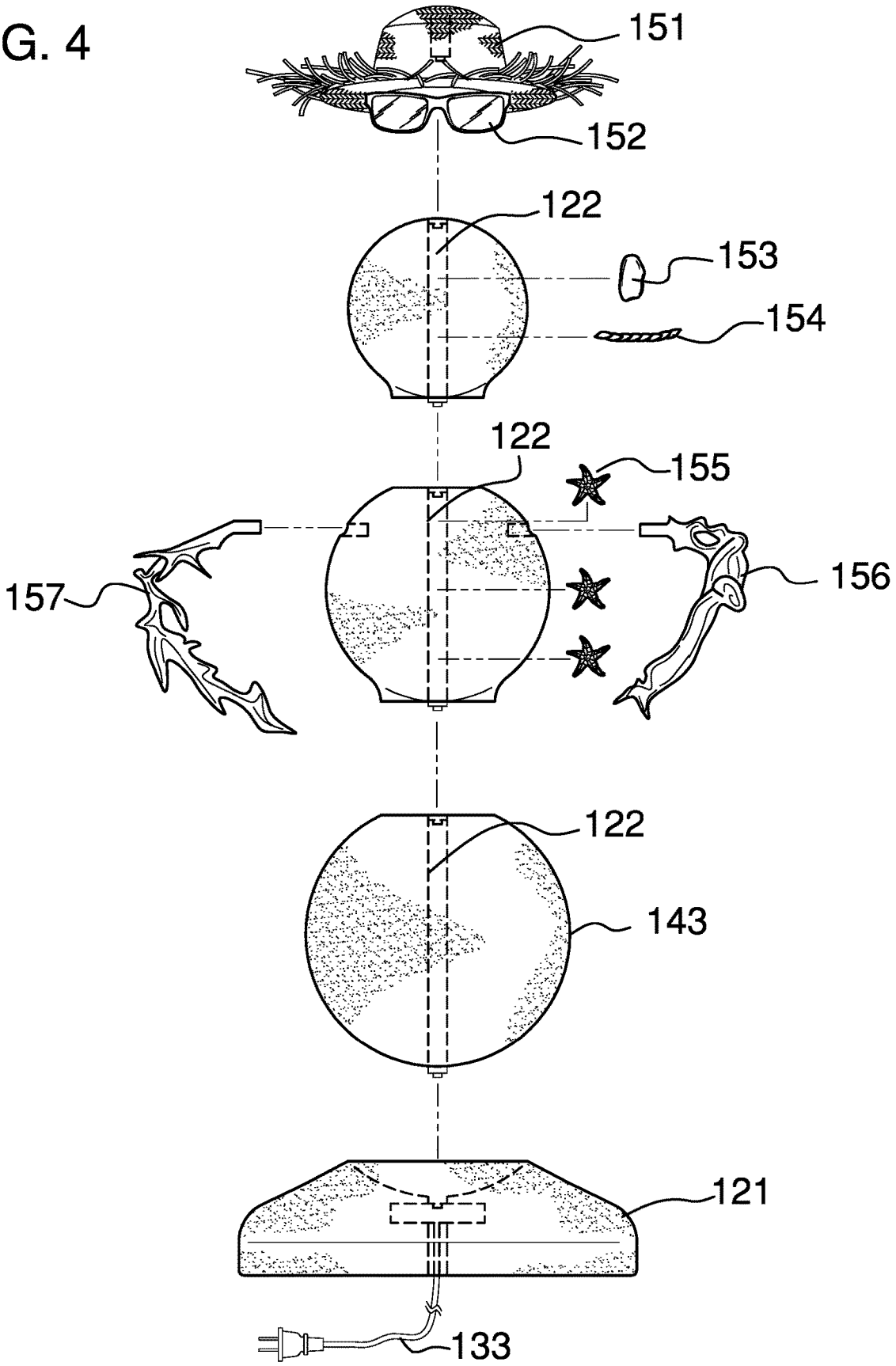
FIG. 4 is an exploded view of an embodiment of the disclosure.
Figure 5:
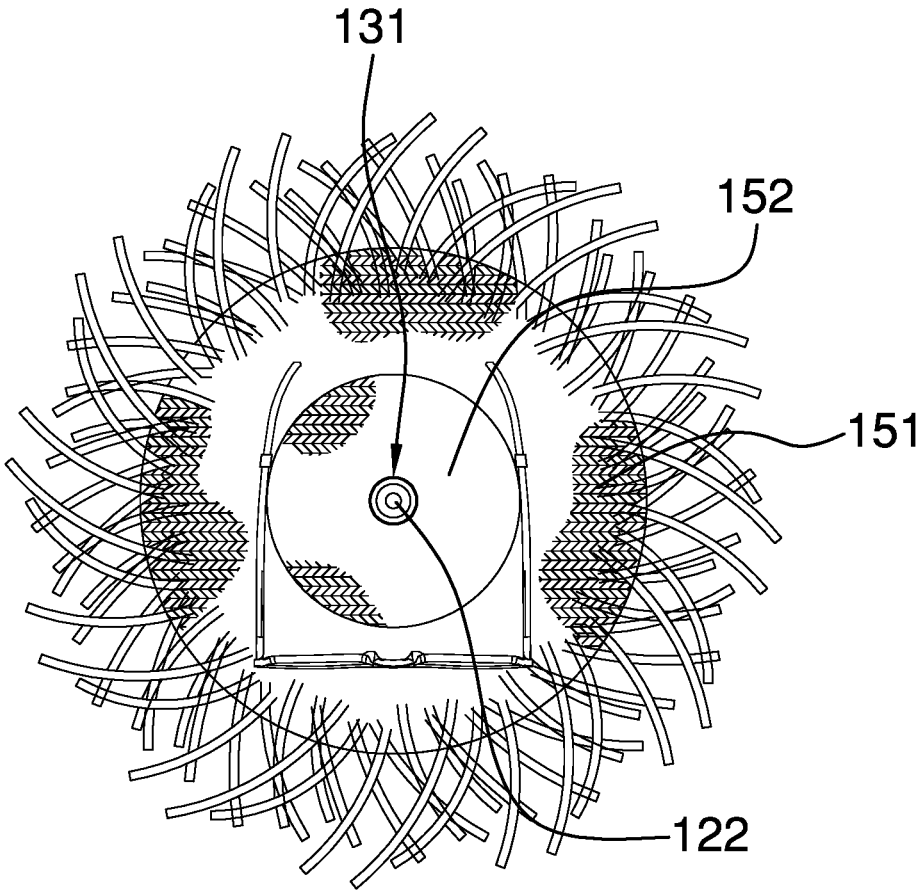
FIG. 5 is a bottom view of an embodiment of the disclosure.

Detailed reference will now be made to one or more potential embodiments of the disclosure, which are illustrated in FIGS. 1 through 5.

The decorative illuminated sandman figurine 100 (hereinafter invention) is a decorative structure. The invention 100 forms a figurine. The invention 100 presents an image of one or more indicia. The indicia presented by the invention 100 stimulates a sentiment within a viewer. The sentiment stimulated by the invention 100 includes sentiments associated with winter. The sentiment stimulated by the invention 100 further includes sentiments associated with a beach. The invention 100 comprises a puppet structure 101, a pedestal structure 102, and a lamp circuit 103. The lamp circuit 103 illuminates the puppet structure 101. The pedestal structure 102 forms load bearing structure that transfers the load of the puppet structure 101 to a supporting surface.

The puppet structure 101 forms the primary shape of the invention 100. The puppet structure 101 forms the figurine that is presented by the invention 100. The puppet structure 101 mounts on the pedestal structure 102. The puppet structure 101 is a semitransparent structure that allows light that is generated by the lamp circuit 103 to be seen from the environment around the puppet structure 101. The puppet structure 101 is intended to present indicia that stimulate the sentiment of a snowman in winter. The puppet structure 101 is intended to present indicia that stimulate the sentiment of being at the beach. The puppet structure 101 comprises a plurality of spherical structures 111 and a plurality of decorative structures 112.

Each spherical structure selected from the plurality of spherical structures 111 is a sphere based structure. Each selected spherical structure is formed is a sphere based shape selected from the group consisting of: a) a spherical section;

and, b) a spherical trifurcation. Each selected spherical structure is formed as the major furcation of the selected sphere based shape. The plurality of spherical structures 111 are stacked on each other to such that the stacked plurality of spherical structures 111 stimulate the sentiment of a snow man.

Each spherical structure selected from the plurality of spherical structures 111 is a hollow structure. Each selected spherical structure is formed from a semitransparent material. Each selected spherical structure has a textured exterior surface. The texture of each selected spherical structure is selected to present indicia that stimulate the sentiment that the plurality of spherical structures 111 are made of sand.

Each spherical structure selected from the plurality of spherical structures 111 is made with a different diameter. By different diameter is meant that the span of the length of the outer diameter of any first spherical structure selected from the plurality of spherical structures 111 does not equal the span of the length of the outer diameter of any second spherical structure selected from the plurality of spherical structures 111.

The plurality of spherical structures 111 comprises a superior spherical structure 141, an intermediate spherical structure 142, and an inferior spherical structure 143.

The inferior spherical structure 143 is a spherical structure selected from the plurality of spherical structures 111. The inferior spherical structure 143 is the spherical structure of the plurality of spherical structures 111 that rests directly on the pedestal structure 102. The inferior spherical structure 143 is formed as a spherical trifurcation. The inferior spherical structure 143 is formed from the major furcation of the spherical trifurcation. The inferior spherical structure 143 planar surface formed by the separation of the major furcation of the inferior spherical structure 143 and the first minor furcation of the inferior spherical structure 143 rests directly on the superior congruent end of the pedestal base structure 121 of the pedestal structure 102. The inferior spherical structure 143 is a hollow structure. The inferior spherical structure 143 is formed from a semitransparent material. The inferior spherical structure 143 is has a textured exterior surface. The intermediate spherical structure 142 is a spherical structure selected from the plurality of spherical structures 111.

The intermediate spherical structure 142 is the spherical structure of the plurality of spherical structures 111 that rests directly on the inferior spherical structure 143. The intermediate spherical structure 142 is formed as a spherical trifurcation. The intermediate spherical structure 142 is formed from the major furcation of the spherical trifurcation. The intermediate spherical structure 142 planar surface formed by the separation of the major furcation of the intermediate spherical structure 142 and the first minor furcation of the intermediate spherical structure 142 rests directly on the planar structure of the second minor furcation of the inferior spherical structure 143. The intermediate spherical structure 142 is a hollow structure. The intermediate spherical structure is formed from a semitransparent material. The intermediate spherical structure 142 is has a textured exterior surface. The span of the length of the outer diameter of the intermediate spherical structure 142 is less than or equal to the span of the length of the outer diameter of the inferior spherical structure 143.

The superior spherical structure 141 is a spherical structure selected from the plurality of spherical structures 111. The superior spherical structure 141 is the spherical structure of the plurality of spherical structures 111 that rests directly on the intermediate spherical structure 142. The superior spherical structure 141 is formed as a spherical section. The superior spherical structure 141 is formed from the major furcation of the spherical trifurcation. The superior spherical structure 141 planar surface formed by the separation of the major furcation of the superior spherical structure 141 and the minor furcation of the superior spherical structure 141 rests directly on the planar structure of the second minor furcation of the intermediate spherical structure 142. The superior spherical structure 141 is a hollow structure. The superior spherical structure 141 is formed from a semitransparent material. The superior spherical structure 141 is has a textured exterior surface. The span of the length of the outer diameter of the superior spherical structure 141 is less than or equal to the span of the length of the outer diameter of the intermediate spherical structure 142.

Each decorative structure selected from the plurality of decorative structures 112 is a decorative item. Each decorative structure selected from the plurality of decorative structures attaches to a spherical structure selected from the plurality of spherical structures 111. Each selected decorative structure presents the image of an indicia that stimulate the sentiment of a beach. The plurality of decorative structures 112 are positioned on the plurality of spherical structures 111 such that the overall image that stimulates the sentiment of a snow man decorated with beach items. The plurality of decorative structures 112 comprises a straw hat 151, a sunglasses 152, a nose structure 153, a rope mouth 154, a plurality of star fish buttons 155, a left driftwood arm 156, and a right driftwood arm 157.

The straw hat 151 is a decorative item that is worn on the superior region of the superior spherical structure 141. The straw hat 151 stimulates a sentiment that makes the superior spherical structure 141 look like the head of a snow man.

The sunglasses 152 is a decorative item that is worn on the superior spherical structure 141. The sunglasses 152 stimulates a sentiment that makes the snow man appear to have eyes.

The nose structure 153 is a decorative item that is worn on the superior spherical structure 141. The nose structure 153 stimulates a sentiment that makes the snow man appear to have a nose. The sentiment stimulated by the nose structure 153 is enhanced by resting the sunglasses 152 on the nose structure 153.

The rope mouth 154 is a decorative item that is worn on the superior spherical structure 141. The rope mouth 154 stimulates a sentiment that makes the snow man appear to have a mouth.

The plurality of star fish buttons 155 is a decorative item that is worn on the intermediate spherical structure 142. The plurality of star fish buttons 155 stimulates a sentiment that makes the snow man appear to be wearing a garment such as a coat or a shirt.

The left driftwood arm 156 is a decorative item that is worn on the intermediate spherical structure 142. The left driftwood arm 156 stimulates a sentiment that makes the snow man appear to have a left arm.

The right driftwood arm 157 is a decorative item that is worn on the intermediate spherical structure 142. The right driftwood arm 157 stimulates a sentiment that makes the snow man appear to have a right arm.

The pedestal structure 102 is a mechanical structure. The pedestal structure 102 is a load bearing structure. The pedestal structure 102 transfers the load of the puppet structure 101 to a supporting surface. The puppet structure 101 mounts directly on the pedestal structure 102. The puppet structure 101 mounts on the pedestal structure 102 such that the pedestal structure 102 holds the components of the puppet structure 101 in a fixed position relative to each other. The pedestal structure 102 comprises a pedestal base structure 121 and a stanchion structure 122.

The pedestal base structure 121 is a roughly disk shaped structure. The pedestal base structure 121 forms the inferior structure of the invention 100. The pedestal base structure 121 forms a portion of the load path that transfers the load of the puppet structure 101 to a supporting surface. The pedestal base structure 121 forms the final link in the load path to the supporting surface. The pedestal base structure 121 rests directly on the supporting surface such that the pedestal base structure 121 elevates the puppet structure 101 above the supporting surface.

The stanchion structure 122 is a stanchion. The stanchion structure 122 is a prism shaped structure. The stanchion structure 122 is a load bearing structure. The stanchion structure 122 transfers a portion of the load of the puppet structure 101 to the pedestal base structure 121. The stanchion structure 122 mounts on the superior congruent end of the disk structure of the pedestal base structure 121.

The stanchion structure 122 projects vertically away from the pedestal base structure 121 in the superior direction. The stanchion structure 122 projects perpendicularly away from the superior congruent end of the disk structure of the pedestal base structure 121.

The stanchion structure 122 forms a mechanical structure that aligns the center axes of the plurality of spherical structures 111 as they are stacked on each other. The plurality of fiber optic cables 131 of the lamp circuit 103 are wrapped around the stanchion structure 122 such that the illumination generated by the illumination circuit 132 of the lamp circuit 103 is distributed through the plurality of spherical structures 111.

The lamp circuit 103 is an electrically powered circuit. The lamp circuit 103 generates an illumination within the hollow interiors of each sphere structure selected from the plurality of spherical structures 111. The illumination generated by the lamp circuit 103 is visible from the environment surrounding the invention 100. The lamp circuit 103 mounts on the pedestal structure 102. The lamp circuit 103 comprises a plurality of fiber optic cables 131, an illumination circuit 132, and an external power source 133.

Each fiber optic cable selected from the plurality of fiber optic cables 131 is an optical device. Each selected fiber optic cable forms a guide path that guides the transmission of light from illumination circuit 132 to the location within the plurality of spherical structures 111 from which the transmitted light will be visible. Each selected fiber optic cable physically wraps around the stanchion structure 122 of the pedestal structure 102. The distribution of released light within the plurality of spherical structures 111 is selected by individually selecting the span of the length of each fiber optic cable selected from the plurality of fiber optic cables 131.

The illumination circuit 132 is an electric circuit. The illumination circuit 132 generates an illumination that is used to illuminate the interior spaces of each spherical structure selected from the plurality of spherical structures 111. The illumination circuit 132 transmits the generated illumination into each fiber optic cable selected from the plurality of fiber optic cables 131 such that the path of the generated illumination is guided within the spherical structure selected from the plurality of spherical structures 111.

The external power source 133 is an externally provided source of electric energy. The external power source 133 is defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Barrier: As used in this disclosure, a barrier is a physical obstacle that forms a boundary between a first space and a second space. The barrier prevents the passage of an object between the first space and the second space.

Bifurcate: As used in this disclosure, to bifurcate means to divide an object or space into two pieces or segments.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Environment: As used in this disclosure, an environment refers to the physical conditions surrounding an object. The term environment is often limited to the physical conditions that the object interacts with.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Fiber Optic Cable: As used in this disclosure, a fiber optic cable is a glass or plastic cable that is used to transmit or conduct light instead of electricity.

Figurine: As used in this disclosure, a figurine is a three dimensional structure resembling (or representing) a human, animal, natural, or symbolic sentiment.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Furcate: As used in this disclosure, to furcate or furcation refers to the division of an object into a plurality branches, pieces, spaces, or segments.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Illumination: As used in this disclosure, illumination refers to electromagnetic radiation contained with an area. Illumination is a synonym for light, particularly in cases where a measure of the amount of visible electromagnetic radiation in a space is called for. The verb form of illumination is to illuminate and is taken to mean the generation of an illumination.

Image: As used in this disclosure, an image is an optical representation or reproduction of an indicia or of the appearance of something or someone. See indicia sentiment optical character recognition. See Label and Pattern.

Indicia: As used in this disclosure, the term indicia refers to a set of markings that identify a sentiment. See sentiment.

Inert: As used in this disclosure, inert is an adjective that is applied to an object, system, or chemical reaction. Inert means that the object, system, or chemical reaction is incapable of internal motion, internal activity or is otherwise unreactive.

Inferior: As used in this disclosure, the term inferior refers to a directional reference that is parallel to and in the same direction as the force of gravity when an object is positioned or used normally.

Inner Diameter: As used in this disclosure, the term inner diameter is used in the same way that a plumber would refer to the inner diameter of a pipe.

Interior: As used in this disclosure, the interior is used as a relational term that implies that an object is contained within the boundary of a structure or a space.

Intermediate: As used in this disclosure, the term intermediate refers to a location that lies between a first object and a second object.

Intermediate Structure: As used in this disclosure, an intermediate structure refers is an inert structure that attaches a first object to a second object.

Lamp: As used in this disclosure, a lamp is an electrical device that generates visible light to illuminate objects so they can be seen.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Opaque: As used in this disclosure, opaque refers to an object or material that prevents the passage of radiation through the object or material.

Outer Diameter: As used in this disclosure, the term outer diameter is used in the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Puppet: As used in this disclosure, a puppet is a three-dimensional figure resembling a human, animal, or symbolic image.

Radial: As used in this disclosure, the term radial refers to a direction that: 1) is perpendicular to an identified central axis; or, 2) projects away from a center point.

Roughly: As used in this disclosure, roughly refers to a comparison between two objects. Roughly means that the difference between one or more parameters of the two compared objects are not significantly different.

Semitransparent: As used in this disclosure, semitransparent refers to an object that is partially transparent. By partially transparent is meant: a) that only a proportion of the light that strikes a semitransparent structure will pass through the semitransparent structure; and, b) that the light is scattered as it passes through the semitransparent structure such that objects cannot be clearly seen through the semitransparent structure. Use tinted when objects can be clearly seen.

Sentiment: As used in this disclosure, a sentiment refers to a symbolic meaning or message that is communicated through the use of an object or an image, potentially including a text based image. See image and optical character recognition.

Sphere: As used in this disclosure, a sphere refers to a structure wherein every point of the surface of the structure is equidistant from a center point. A circle refers to the two dimensional structure that that is projected onto the bifurcating plane of a spherical section by the surface of the sphere. All the points of the circle are equidistant from a center point that is found by the perpendicular projection of the center of the sphere on the bifurcating plane.

Spherical Section: As used in this disclosure, a spherical section refers one of the two objects formed by the bifurcation of a sphere by a plane that does not pass through the center of the sphere. The major section is the spherical section that contains the larger volume. The minor section is the spherical section that contains the smaller volume. A spherical section is commonly called a spherical cap. The term spherical section is also applied to a semi-spherical structure.

Spherical Trifurcation: As used in this disclosure, a spherical trifurcation is a roughly disk-shaped object that is formed from a sphere after two diametrically opposed spherical sections have been removed. The lateral face of each spherical trifurcation has a spherical curvature. The spherical section that forms the spherical trifurcation with the greatest volume is called the major furcation. The spherical sections that form the spherical trifurcations with the lesser volumes are called the first and second minor furcations.

Stack: As used in this disclosure, a stack refers to a collection of objects that are positioned such that the centers of the objects are aligned. The term stack typically implies that the aligned centers are vertically oriented.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Texture: As used in this disclosure, a texture is a tactile or three-dimensional structure formed on a surface. In daily use, texture will on occasion refer to a visual characteristic of the surface.

Transparent: As used in this disclosure, transparent refers to a material that allows light to pass through the material without significant scattering such that an object can be clearly seen through the material.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A decorative illuminated sandman figurine comprising a puppet structure, a pedestal structure, and a lamp circuit;
wherein the lamp circuit illuminates the puppet structure;
wherein the pedestal structure forms load bearing structure that transfers the load of the puppet structure to a supporting surface;
wherein the pedestal structure comprises a pedestal base structure and a stanchion structure;
wherein the stanchion structure attaches to the pedestal base structure;
wherein a plurality of decorative structures comprises a straw hat, a sunglasses, a nose structure, a rope mouth, a plurality of star fish buttons, a left driftwood arm, and a right driftwood arm;
wherein the plurality of decorative structures adorn the puppet structure;
wherein the stanchion structure transfers a portion of the load of the puppet structure to the pedestal base structure;
wherein the stanchion structure mounts on a superior congruent end of the pedestal base structure;
wherein the stanchion structure projects vertically away from the pedestal base structure in a superior direction;
wherein the stanchion structure projects perpendicularly away from the superior congruent end of the pedestal base structure;
wherein the decorative illuminated sandman figurine is a decorative structure;
wherein the decorative illuminated sandman figurine forms a figurine;
wherein the decorative illuminated sandman figurine presents an image of one or more indicia;
wherein the indicia presented by the decorative illuminated sandman figurine stimulates a sentiment;
wherein the sentiment stimulated by the decorative illuminated sandman figurine further includes sentiments associated with a beach;
wherein the puppet structure forms the primary shape of the decorative illuminated sandman figurine;
wherein the puppet structure forms the figurine that is presented by the decorative illuminated sandman figurine;
wherein the puppet structure mounts on the pedestal structure;
wherein the puppet structure is a semitransparent structure that allows light that is generated by the lamp circuit to be seen from the environment around the puppet structure;
wherein the puppet structure presents indicia that stimulate the sentiment of a snowman in winter;
wherein the puppet structure presents indicia that stimulate the sentiment of being at the beach;
wherein the pedestal structure is a mechanical structure;
wherein the pedestal structure is a load bearing structure;
wherein the pedestal structure transfers the load of the puppet structure to a supporting surface;
wherein the puppet structure mounts directly on the pedestal structure;
wherein the puppet structure mounts on the pedestal structure such that the pedestal structure holds the components of the puppet structure in a fixed position relative to each other;
wherein the lamp circuit is an electrically powered circuit;
wherein the lamp circuit generates an illumination within hollow interiors of each sphere structure selected from the plurality of spherical structures;
wherein the illumination generated by the lamp circuit is visible from an environment surrounding the decorative illuminated sandman figurine;
wherein the lamp circuit mounts on the pedestal structure;
wherein the puppet structure comprises a plurality of spherical structures and a plurality of decorative structures;
wherein the plurality of decorative structures mount on the plurality of spherical structures;
wherein the lamp circuit comprises a plurality of fiber optic cables, an illumination circuit, and an external power source;
wherein each selected fiber optic cable forms a guide path that guides the transmission of light from illumination circuit to a location within the plurality of spherical structures from which the transmitted light will be visible;
wherein the external power source is an externally provided source of electric energy;

wherein each spherical structure selected from the plurality of spherical structures is a sphere based structure;

wherein each selected spherical structure is formed is a sphere based shape selected from the group consisting of: a) a spherical section; and, b) a truncated sphere;

wherein the plurality of spherical structures are stacked on each other to such that the stacked plurality of spherical structures stimulate the sentiment of a snow man;

wherein each spherical structure selected from the plurality of spherical structures is a hollow structure;

wherein each selected spherical structure is formed from a semitransparent material;

wherein each selected spherical structure has a textured exterior surface;

wherein the texture of each selected spherical structure is selected to present indicia that stimulate the sentiment that the plurality of spherical structures are made of sand;

wherein each spherical structure selected from the plurality of spherical structures is made with a different diameter;

wherein by different diameter is meant that the span of the length of the outer diameter of any first spherical structure selected from the plurality of spherical structures does not equal the span of the length of the outer diameter of any second spherical structure selected from the plurality of spherical structures;

wherein the plurality of spherical structures comprises a superior spherical structure, an intermediate spherical structure, and an inferior spherical structure;

wherein the inferior spherical structure is a spherical structure selected from the plurality of spherical structures;

wherein the inferior spherical structure is the spherical structure of the plurality of spherical structures that rests directly on the pedestal structure;

wherein the inferior spherical structure is formed as a truncated sphere;

wherein the inferior spherical structure is formed from the truncated sphere;

wherein the inferior spherical structure of the inferior spherical structure rests directly on the superior congruent end of the pedestal base structure of the pedestal structure;

wherein the inferior spherical structure is a hollow structure;

wherein the inferior spherical structure is formed from a semitransparent material;

wherein the inferior spherical structure has a textured exterior surface;

wherein the intermediate spherical structure is a spherical structure selected from the plurality of spherical structures;

wherein the intermediate spherical structure is the spherical structure of the plurality of spherical structures that rests directly on the inferior spherical structure;

wherein the intermediate spherical structure is formed as a truncated sphere;

wherein the intermediate spherical structure is formed from the truncated sphere;

wherein the intermediate spherical structure planar surface of the intermediate spherical structure rests directly on the planar structure of the inferior spherical structure;

wherein the intermediate spherical structure is a hollow structure;

wherein the intermediate spherical structure is formed from a semitransparent material;

wherein the intermediate spherical structure has a textured exterior surface;

wherein the span of the length of the outer diameter of the intermediate spherical structure is less than or equal to the span of the length of the outer diameter of the inferior spherical structure;

wherein the superior spherical structure is a spherical structure selected from the plurality of spherical structures;

wherein the superior spherical structure is the spherical structure of the plurality of spherical structures that rests directly on the intermediate spherical structure;

wherein the superior spherical structure is formed as a spherical section;

wherein the superior spherical structure is formed from the truncated sphere;

wherein the superior spherical structure planar surface of the superior spherical structure rests directly on the planar structure of the intermediate spherical structure;

wherein the superior spherical structure is a hollow structure;

wherein the superior spherical structure is formed from a semitransparent material;

wherein the superior spherical structure has a textured exterior surface;

wherein the span of the length of the outer diameter of the superior spherical structure is less than or equal to the span of the length of the outer diameter of the intermediate spherical structure;

wherein each decorative structure selected from the plurality of decorative structures is a decorative item;

wherein each decorative structure selected from the plurality of decorative structures attaches to a spherical structure selected from the plurality of spherical structures;

wherein the plurality of decorative structures are positioned on the plurality of spherical structures such that the overall image that stimulates the sentiment of a snow man decorated with beach items;

wherein the pedestal base structure is a disk shaped structure;

wherein the pedestal base structure forms the inferior structure of the decorative illuminated sandman figurine;

wherein the pedestal base structure forms a portion of the load path that transfers the load of the puppet structure to a supporting surface;

wherein the pedestal base structure forms the final link in the load path to the supporting surface;

wherein the pedestal base structure rests directly on the supporting surface such that the pedestal base structure elevates the puppet structure above the supporting surface;

wherein the stanchion structure is a prism shaped structure;

wherein the stanchion structure is a load bearing structure;

wherein the stanchion structure forms a mechanical structure that aligns the center axes of the plurality of spherical structures as they are stacked on each other;

wherein the plurality of fiber optic cables of the lamp circuit are wrapped around the stanchion structure such that the illumination generated by the illumination circuit of the lamp circuit is distributed through the plurality of spherical structures.

2. The decorative illuminated sandman figurine according to claim 1 wherein each fiber optic cable selected from the plurality of fiber optic cables is an optical device;

wherein each selected fiber optic cable physically wraps around the stanchion structure of the pedestal structure;

wherein the distribution of released light within the plurality of spherical structures is selected by individually selecting the span of the length of each fiber optic cable selected from the plurality of fiber optic cables;

wherein the illumination circuit is an electric circuit;

wherein the illumination circuit generates an illumination that is used to illuminate the interior spaces of each spherical structure selected from the plurality of spherical structures;

wherein the illumination circuit transmits the generated illumination into each fiber optic cable selected from the plurality of fiber optic cables such that the path of the generated illumination is guided within the spherical structure selected from the plurality of spherical structures.

3. The decorative illuminated sandman figurine according to claim 1 wherein the straw hat is a decorative item that is worn on a superior region of the superior spherical structure;

wherein the straw hat stimulates a sentiment that makes the superior spherical structure look like the head of a snow man;

wherein the sunglasses is a decorative item that is worn on the superior spherical structure;

wherein the sunglasses stimulates a sentiment that makes the snow man appear to have eyes;

wherein the nose structure is a decorative item that is worn on the superior spherical structure;

wherein the nose structure stimulates a sentiment that makes the snow man appear to have a nose;

wherein the sentiment stimulated by the nose structure is enhanced by resting the sunglasses on the nose structure;

wherein the rope mouth is a decorative item that is worn on the superior spherical structure;

wherein the rope mouth stimulates a sentiment that makes the snow man appear to have a mouth;

wherein the plurality of star fish buttons is a decorative item that is worn on an intermediate spherical structure;

wherein the plurality of star fish buttons stimulates a sentiment that makes the snow man appear to be wearing a garment such as a coat or a shirt;

wherein the left driftwood arm is a decorative item that is worn on the intermediate spherical structure;

wherein the left driftwood arm stimulates a sentiment that makes the snow man appear to have a left arm;

wherein the right driftwood arm is a decorative item that is worn on the intermediate spherical structure;

wherein the right driftwood arm stimulates a sentiment that makes the snow man appear to have a right arm.

* * * * *